United States Patent [19]

Parker

[11] Patent Number: 4,827,913

[45] Date of Patent: May 9, 1989

[54] PASSIVE EXERCISING APPARATUS

[76] Inventor: Alonzo E. Parker, P.O. Box 11276, Durham, N.C. 27703

[21] Appl. No.: 245,024

[22] Filed: Sep. 16, 1988

[51] Int. Cl.[4] ..... A61H 1/02

[52] U.S. Cl. ..... 128/25 R; 128/70

[58] Field of Search ..... 128/25 R, 68, 70, 72, 128/73, 74; 269/322, 325; 272/144

[56] References Cited

U.S. PATENT DOCUMENTS

| | | | |
|---|---|---|---|
| Re. 16,653 | 6/1927 | Evins | 128/73 |
| 1,686,979 | 10/1928 | McManis | 128/25 R |
| 1,938,006 | 12/1933 | Blanchard | 128/74 |
| 2,494,746 | 1/1950 | Colston | 128/25 R X |
| 3,060,925 | 10/1962 | Honsaker et al. | 128/70 |
| 3,071,130 | 1/1963 | Hoyer et al. | 128/25 R |
| 3,620,210 | 11/1971 | Annas et al. | 269/322 X |
| 3,674,017 | 7/1972 | Stefani et al. | 128/25 R |
| 4,723,537 | 2/1988 | Parker, Jr. | 128/25 R |

*Primary Examiner*—Richard J. Apley
*Assistant Examiner*—Howard Flaxman
*Attorney, Agent, or Firm*—Olive & Olive

[57] ABSTRACT

A passive exercising apparatus comprises a first stationary horizontal platform connected to a second platform forming a lengthwise extension of the first platform and connected thereto for relatively pivotal or rotative movement. A drive mechanism is supported below the second platform and includes slotted lever arms and adjustable linkages enabling the second platform to be selectively pivoted up-and-down or about its central longitudinal axis so as to vary the type of exercise obtained. The second platform is capable of simultaneous pivoting and twisting motion.

5 Claims, 6 Drawing Sheets

PASSIVE EXERCISING APPARATUS

BACKGROUND OF THE INVENTION

1. Field of the Invention

The present invention relates to an exercising apparatus, and in particular, to a passive exercising apparatus. The apparatus supports a user and includes a first fixed table and a second movable table.

2. Description of the Related Art

Applicant's prior U.S. Pat. No. 4,723,537 teaches a passive exercise device having a fixed table and a movable table. The movable table is pivotable with respect to the fixed table by means of a drive mechanism. The drive mechanism is connected to linkages which impart a combined up-and-down and oscillating motion to the movable table.

U.S. Pat. No. 3,674,017 teaches a passive exercising apparatus which moves the torso with respect to the legs or from a prone to a sitting position. The apparatus incorporates a first stationary table and a second table which pivots relative to the first. While such an apparatus is useful for invalids as well as overweight persons desiring to lose weight, it does not allow the body to be twisted or to be simultaneously twisted and pivoted to enhance exercising of stomach and back muscles. Also, the apparatus disclosed in this patent is not able to pivot any portion of the body below a horizontal plane.

The passive exercising apparatus of U.S. Pat. No. 2,598,204 allows portions of the body to be pivoted below a horizontal plane. However, the apparatus does not provide for twisting of the body or for simultaneous twisting and pivoting.

U.S. Pat. No. 2,494,746 also teaches a passive exercising apparatus which imparts vertical and horizontal reciprocating as well as circular motion to a body table. However, this apparatus cannot be adjusted so as to selectively deliver either a pivoting or twisting motion, or both pivoting and twisting motions simultaneously.

U.S. Pat. No. 3,472,222 teaches twisting the head only but otherwise lacks the ability to pivot or twist major portions of the body.

U.S. Pat. No 3,735,754 teaches use of four reciprocating platforms but with no ability to pivot or twist the body.

The art continues to seek improvements. It is desirable that a passive exercise apparatus impart a combined up-and-down and twisting motion to selected portions of a user's body. It is also desirable that such a passive exercise apparatus be easy to use and economical to manufacture.

SUMMARY OF THE INVENTION

The apparatus of the present invention incorporates a fixed table supported on a frame and a movable table supported on adjustable linkages operated by a pair of slotted lever arms on a common drive shaft. At least one of the slotted lever arms is adjustable on the shaft with respect to its angular relation to the other slotted lever arm. The lever arm shaft is driven by a motor drive. The fixed table connects to and supports the movable table through a hinge connection which can both pivot and rotate. One mode of operation enables the movable table to be pivoted about a fixed longitudinal central axis and in a relatively high or relatively low pivoting motion dependent on how the linkages and slotted lever arms are connected. In another mode of operation, the linkages and slotted lever arms can be connected so as to either pivot the movable platform around a fixed horizontal axis at one end of the fixed platform or pivot the movable platform around a central longitudinal axis to twist the body or simultaneously pivot and twist the selected portion of the body.

DETAILED DESCRIPTION OF THE PREFERRED EMBODIMENTS

Figure 1:
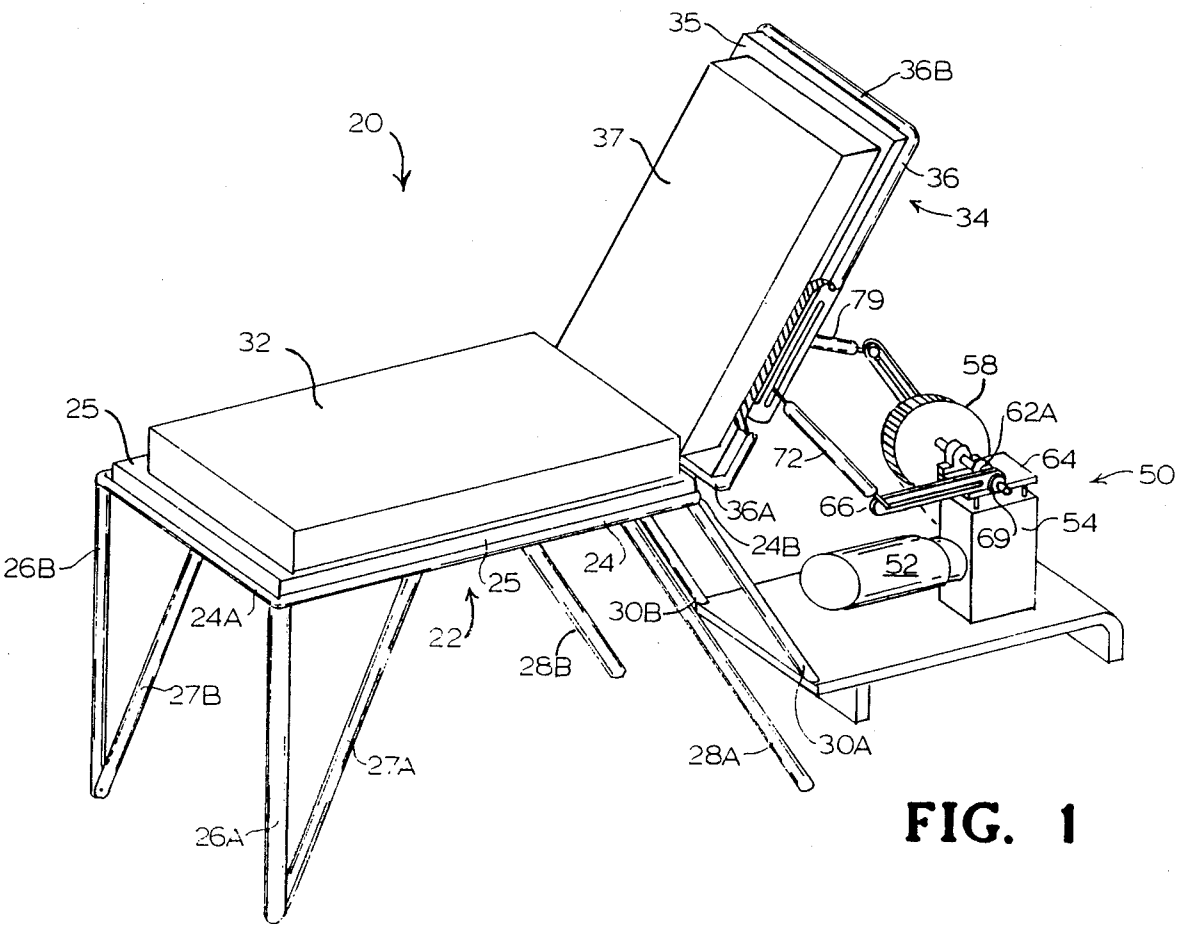
FIG. 1 is a perspective view of the passive exercising apparatus of the invention illustrating a movable table pivoted with respect to a fixed table.

The exercise apparatus of the invention, indicated generally at 20 in FIGS. 1–7, comprises a fixed table 22 for supporting the lower body of a user and a movable table 34 for supporting the upper body of a user. Alternatively, the user may place the upper portion of his or her body on fixed table 22 and the lower portion on movable table 34. It is preferred that the fixed table 22 be substantially horizontal. Preferably the movable table 34 is capable of pivoting with respect to the fixed table 22 from a position slightly below the plane of the fixed table 22 to a position approximately perpendicular to the plane of the fixed table 22.

Fixed table 22 includes a frame 24 constructed from tubular metal or other suitable material. Cross braces (not illustrated) or any suitable sheet material 25 can be utilized to stablize frame 24 and provide additional support for cushion 32 which rests on sheet material 25.

Fixed table 22 includes a first pair of supports or legs 26A and 26B at a first end 24A of frame 24. Braces 27A and 27B stablize legs 26A and 26B. A second pair of legs 28A and 28B are provided at a second end 24B of frame 24. If desired, a third pair of legs 30A and 30B can be provided at the second end 24B of frame 24. It is desired that legs 28A, 28B and 30A, 30B extend angularly away from the frame second end 24B so that angle A (FIG. 2) is greater than 90 degrees. Various braces (not illustrated) may be used to stablize the legs.

Movable table 34 is pivotally connected to fixed table 22. Movable table 34 includes a frame 36 constructed from tubular metal or other suitable material. Cross braces (not illustrated) and any suitable sheet material 35 may be utilized to stabilize frame 36 and provide additional support for cushion 37 which rests on frame 36.

Figure 9:
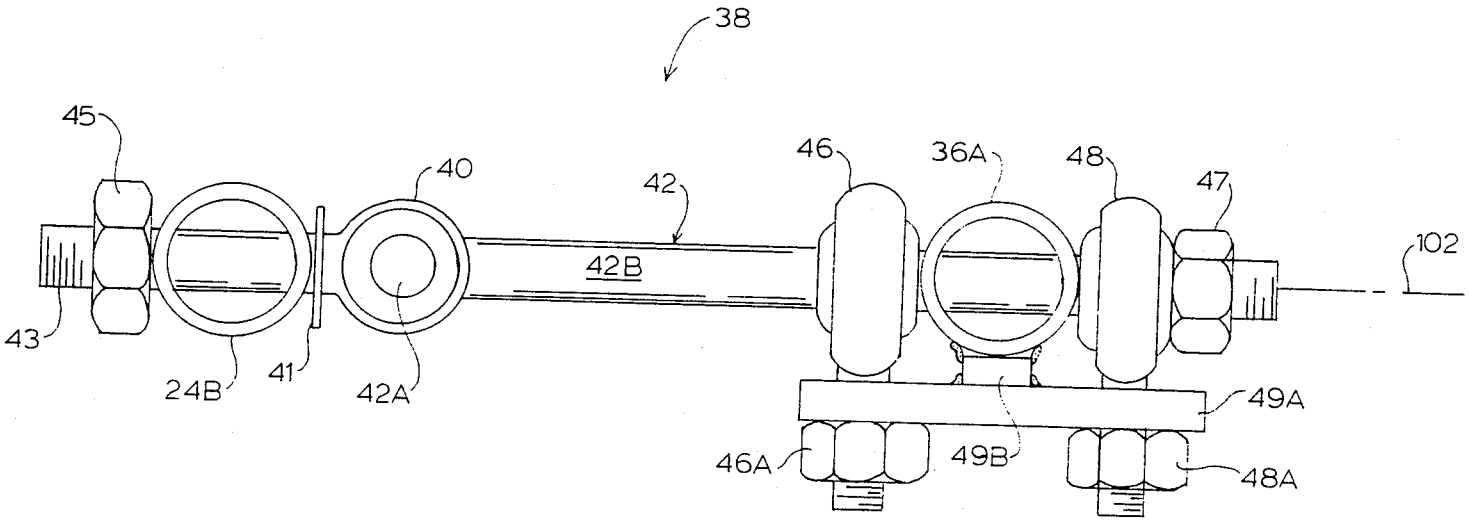
FIG. 9 is an enlarged side elevation view of the hinge connection between the fixed table and the movable table.

A hinge connection 38 (FIGS. 2 and 9) is provided between movable table 34 and fixed table 22. Connection 38 comprises a first and second ball-and-socket joints 40 and 140 mounted on a "T" shaft 42 having a relatively short shaft portion 42A and a relatively long shaft portion 42B. "T" shaft 42 is aligned so that the long shaft portion 42B is parallel to the longitudinal axis of the fixed table 22. A nut 45 is secured to the threaded portion 43 of joint 40 to retain joint 40 to frame end 24B. A washer 41 is mounted between joint 40 and frame end 24B. Joint 140 is connected to frame end 24B in a similar manner.

Connection 38 also includes third and fourth ball-and-socket joints 46 and 48 mounted on long shaft portion 42B and positioned on each side of the first end 36A of frame 36. A nut 47 is threaded on long shaft portion 42B to retain long shaft portion 42B on frame end 36A. A plate 49A is secured to frame end 36A by weld 49B or other suitable means. Nuts 46A and 48A secure joints 46 and 48, respectively, to plate 49A.

Hinge connection 38 enables movable table 34 to pivot about axis 101 (FIG. 8) of short shaft portion 42A. Movable table 34 is also enabled to pivot about axis 102 (FIG. 9) of long shaft portion 42B. Joints 40, 140, 46 and 48 thus enable movable table 34 to pivot in a combined up-and-down and oscillating motion through axes 101 and 102 as described below.

Drive mechanism 50 comprises a motor 52 coupled to a gear reducer 54. It is preferred that motor 52 be a variable speed electric motor and that gear reducer be a right-angle reducer. Reducer 54 is mounted on support stand 56. Motor 52 through gear reducer 54 and chain 57 drives sprockets 55 and 58. Sprocket 58 is fixedly mounted on shaft 60 which is supported by bearings 62A and 62B. Bearings 62A and 62B are in turn mounted on support plate 64 which is mounted on reducer 54.

At a first end of shaft 60, slotted lever arm 66 is removably mounted by fastener 69. At the opposite end of shaft 60, slotted lever arm 68 is removably mounted by fastener 70. Through the use of fasteners 69 and 70, slotted lever arms 66 and 68 can be adjustably mounted on shaft 60 at any desired angular position with respect to one another. As will be described below, by varying the position of one slotted lever arm with respect to the other slotted lever arm, different motions of movable table 34 are achieved. As an alternative to the embodiment of the apparatus 20 illustrated in the figures, only one slotted lever arm need be adjustably connected to shaft 60 to position the lever arm at a desired angular position with respect to the other slotted lever arm.

Linkage 72 is removably connected at a first end to slotted lever arm 66 by fastener 71. At a second end, linkage 72 is removably connected by fastener 73 to a slotted bracket 78 mounted on the underside of frame 36. In a similar manner, linkage 74 is removably connected at a first end to slotted lever arm 68 by fastener 75. At a second end, linkage 74 is removably connected by fastener 79 to a slotted bracket 88 mounted on the underside of frame 36. It will be understood that the respective first ends of linkages 72 and 74 may be mounted at any position in the respective slots of slotted levers arms 66 and 68. Furthermore, the respective second ends of linkages 72 and 74 may be mounted at any position in the respective slots of slotted brackets 78 and 88.

In operation, three types of movement of the movable table 34 can be obtained as the drive mechanism 50 rotates slotted lever arms 66 and 68 and linkages 72 and 74. A first movement involves pivoting movable table 34 about axis 101 of the short shaft portion 42A of the "T" shaft 42. This up-and-down motion occurs as movable table 34 travels from a first position substantially planar to fixed table 22 (or slightly below the plane of fixed table 22) to a second position approximately perpendicular to the fixed table 22. Of course, the range of this up-and-down motion can be varied by adjusting the placement of the ends of linkages 72 and 74 at the slotted lever arms 66 and 68 and the slotted brackets 78 and 88. This first type of movement ("up-and-down") is achieved when the slotted lever arms 66 and 68 are positioned on shaft 60 so that they are substantially angularly aligned with respect to each other as in FIGS. 6 and 7. In other words, each slotted lever arm 66 and 68 is arranged to be at substantially the same angular position with respect to shaft 60.

A second type of motion of the movable table 34 involves pivoting about axis 102 of the long shaft portion 42B of the "T" shaft 42. This motion imparts a twisting or oscillating motion to the user represented by arrow 150 in FIG. 5. This oscillating motion is achieved when the slotted arms 66 and 68 are positioned on shaft 60 so that they are approximately 180 degrees apart from one another as in FIGS. 4 and 5. In other words, the slotted lever arms 66 and 68 are approximately angularly opposed to each other on shaft 60. The range of oscillation about axis 102 can thus be easily varied by adjusting the positions at which the linkages 72 and 74 are secured to the slotted lever arms 66 and 68 and the slotted brackets 78 and 88. A second position of frame 36 is indicated in dotted lines at 152 in FIG. 5.

Figure 2:
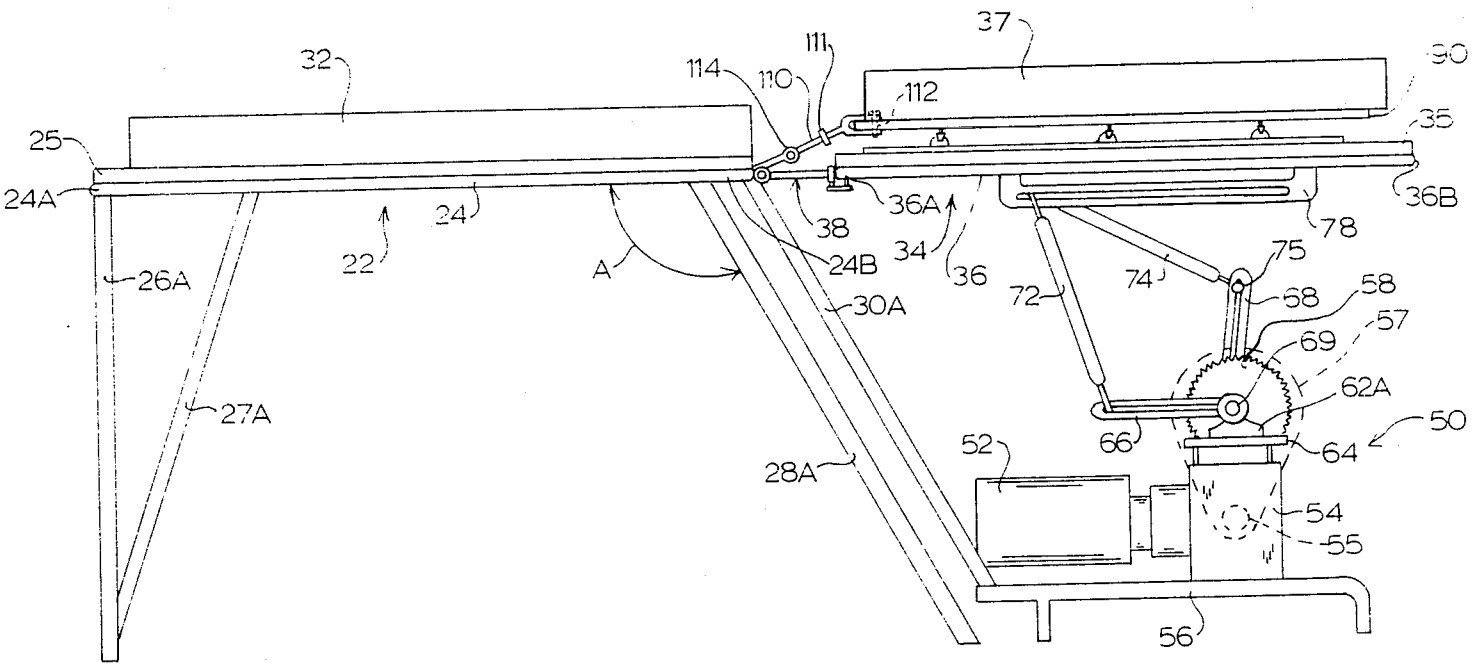
FIG. 2 is a side elevation view of the apparatus of FIG. 1 illustrating the movable table planar with the fixed table and the slotted lever arms angularly displaced from one another in a first position.
Figure 3:
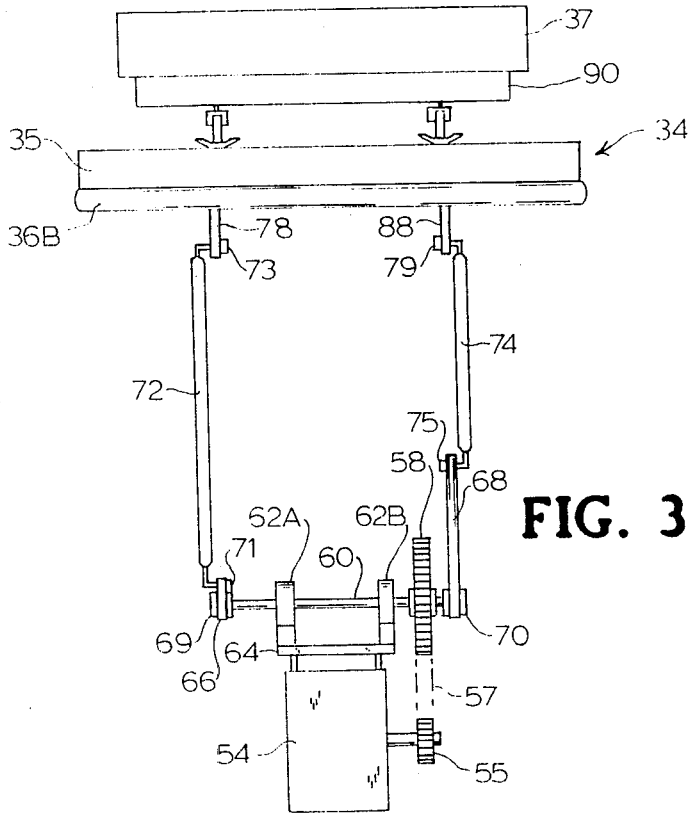
FIG. 3 is an end view of FIG. 2.

A third type of motion of the movable table 34 involves combined pivoting about respective axes 101 and 102 of the short shaft portion 42A and the long shaft portion 42B. This combined motion causes the movable table 34 to travel up-and-down about axis 101 and simultaneously oscillate about axis 102. The range of movement about these axes 101 and 102 can be varied by adjusting the positions of linkages 72 and 74 at the slotted lever arms 66 and 68 and the slotted brackets 78 and 88. This combined motion is achieved when the slotted lever arms 66 and 68 are angularly displaced from one another less than approximately 180° degrees on shaft 60 as illustrated in FIGS. 1–3.

It is preferred that sheet material 35 mount a table 90 supported by sets of rollers 92 (FIG. 6) mounted to travel in a pair of parallel tracks 94A and 94B (FIG. 8) secured to the upper surface of sheet material 35. Cushion 37 and the user's body portion supported on table 90 are thus able to move relative to movable table 34 when movable table 90 is pivoting up-and-down about axis 101.

Figure 8:
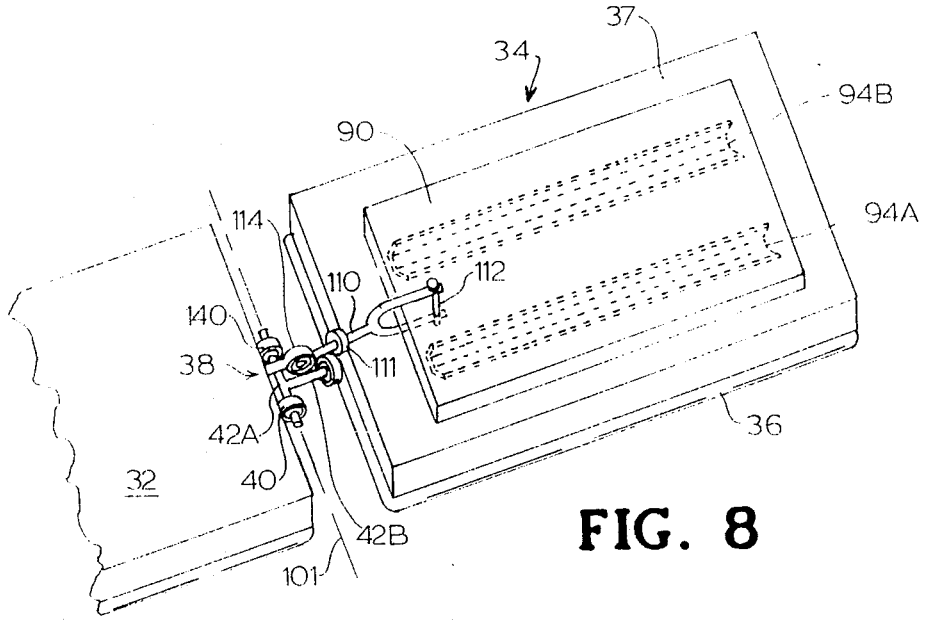
FIG. 8 is an enlarged perspective view of the movable table of the present apparatus illustrating a pivotable yoke and a slidable table.
Figure 4:
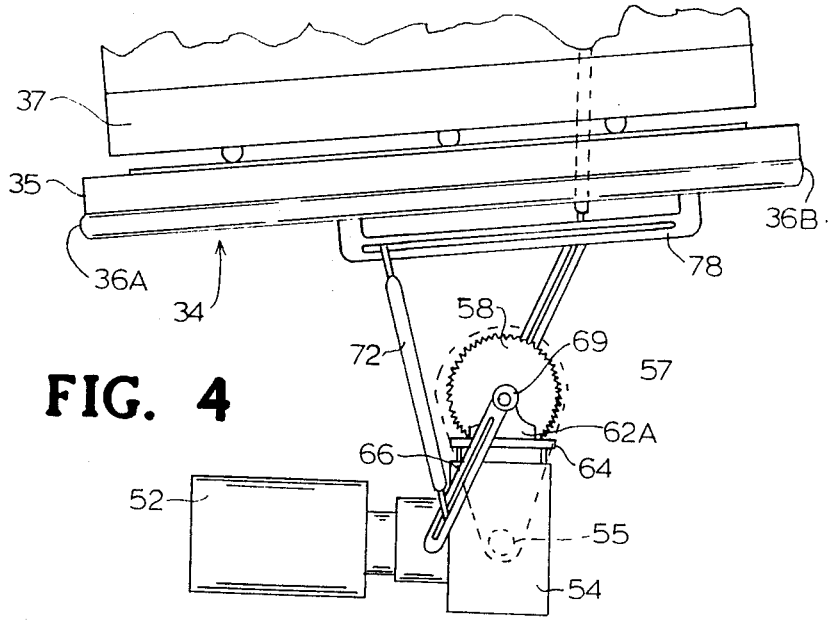
FIG. 4 is a partial-fragmentary side elevation view of the present apparatus illustrating the slotted lever arms angularly displaced approximately 180 degrees from one another in a second position.
Figure 5:
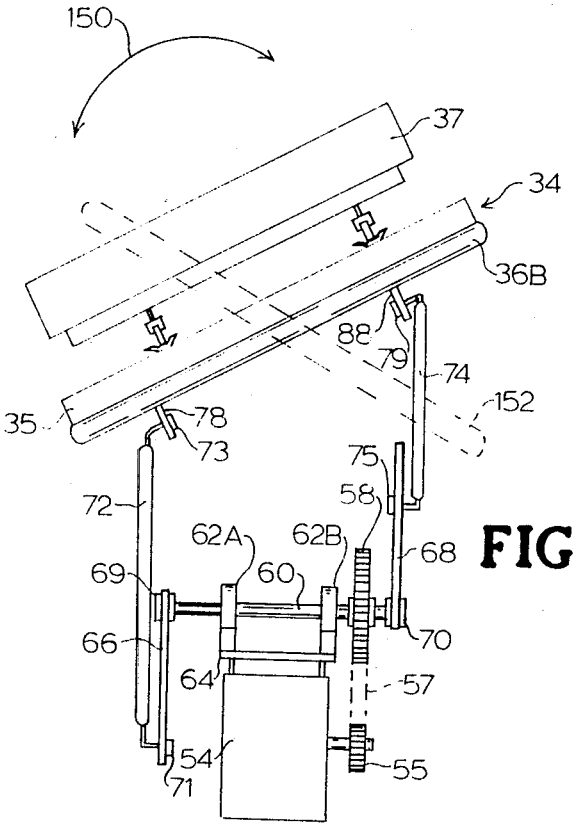
FIG. 5 is an end view of FIG. 4.
Figure 7:
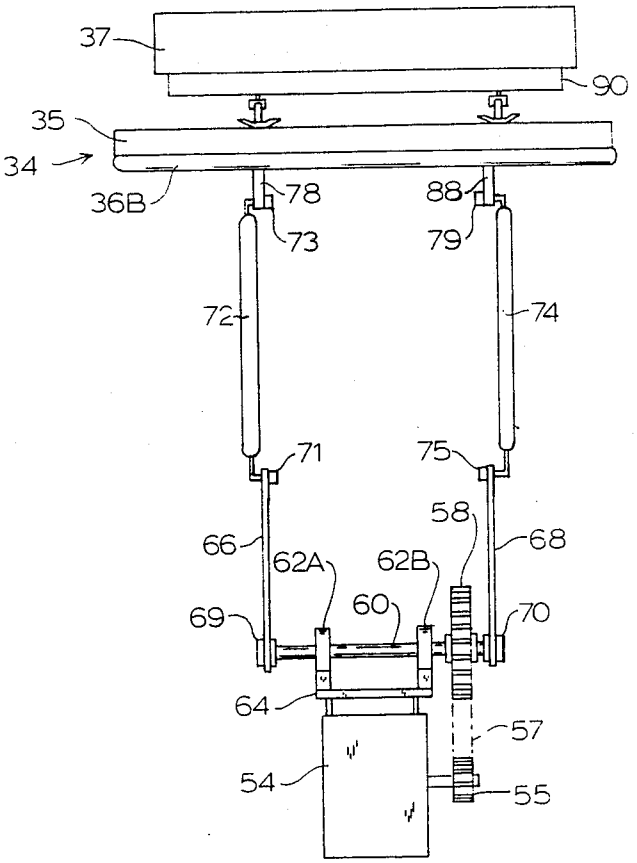
FIG. 7 is an end view of FIG. 6.

As illustrated best in FIG. 8, a pivotable yoke 110 receives table 90. Yoke 110 is secured to frame end 24B and includes pivot joints 114 and 111. As movable table 34 pivots about axis 101 to a position approximately perpendicular to fixed table 22, table 90 moves along tracks 94A, 94B on rollers 92 toward the frame second end 36B. Pivot joint 114 permits yoke 110 to pivot with movable table 34 and remain in contact with table 90. As movable table 34 returns to a position approximately planar with fixed table 22, pin 112 connected through table 90 to yoke 110 causes table 90 to move toward frame first end 36A. As movable table 34 oscillates about axis 102 (FIG. 9), pivot joint 111 permits yoke 110 to oscillate with movable table 134.

Figure 6:
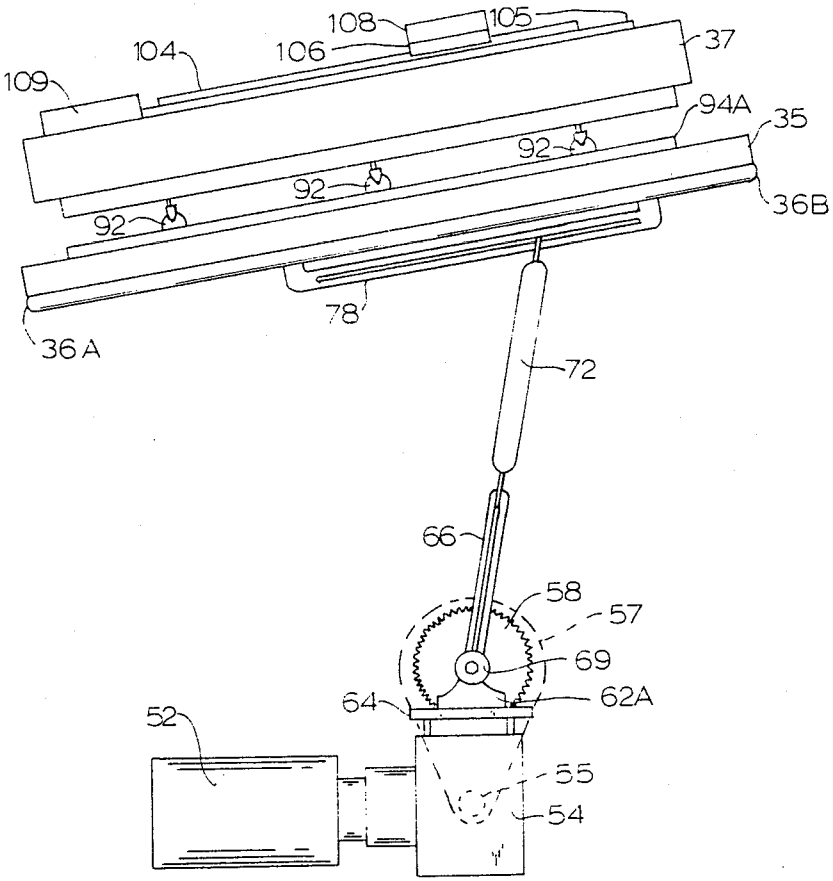
FIG. 6 is a side elevation view of the present apparatus illustrating the slotted lever arms substantially aligned with one another in a third position and a sliding cushion assembly mounted on the movable table.
Figure 10:
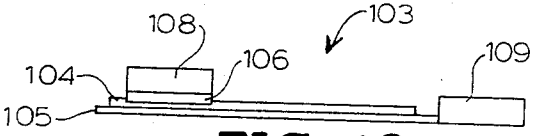
FIG. 10 is a side elevation view of a sliding cushion assembly for use with the present passive exercising apparatus.

As illustrated in FIGS. 6 and 10, it is desirable to provide a sliding cushion assembly 103 on the upper surface of cushion 37. A platform 105 mounts a track 104. A sliding table 106 mounted on coasters (not illustrated) supports sliding cushion 108. A lumbar cushion 109 is provided at the lower end of the platform 105. As movable table 34 pivots about the axis 101, sliding cushion 108 reduces the friction between the user's head and cushion 37.

Various modifications can be made to the present apparatus 20. For example, adjustable hand holds (not illustrated) may be mounted on frame 36 so that a user can maintain his or her position on movable table 34. Also, an adjustable foot rest (not illustrated) can be provided on frame 24 for the comfort of the user.

The present invention offers several advantages over the prior art. Exercise apparatus 20 transmits a wide range of motion to a user. The user can alter the type and range of motion by quickly and easily changing the angular orientation of slotted lever arms 66 and 68 on shaft 60 with respect to one another. Changing the motion does not require repositioning of the drive mechanism 50 or multiple sets of linkages. Exercise apparatus 20 efficiently transfers the power of drive mechanism 50 through a single set of linkages to movable table 34. Slotted lever arms 66 and 68 and slotted brackets 78 and 88 permit easy adjustment to vary the range of motion.

Although the present invention has been described with reference to preferred embodiments, workers skilled in the art will recognize that changes may be made in form and detail without departing from the spirit and scope of the invention.

What is claimed is:

1. A passive exercising apparatus comprising:

(a) a first stationary horizontal platform supported on a frame and adapted to support as desired either a user's upper or lower body portions in a relatively fixed position;

(b) a second platform forming a lengthwise extension of said first platform and connected thereto by means enabling said second platform to pivot about a first axis between said platforms perpendicular to the central longitudinal axis of said second platform and to pivot about a second axis comprising the central longitudinal axis of said second platform or simultaneously pivot about both said axes; and (c) a drive mechanism having:

(i) a pair of laterally spaced lever arms mounted on opposite ends of a horizontal drive shaft, wherein said drive shaft extends parallel to said first axis, at least one of said lever arms being angularly adjustable on said drive shaft with respect to the other lever arm;

(ii) a linkage-bracket assembly including a pair of laterally spaced linkages, each said linkage being adjustably pivotally connected at one end to a respective one of a pair of brackets mounted on said second platform and at the opposite end being adjustably pivotally connectable to one of said lever arms; and (iii) means to drive said drive shaft; wherein said second platform is able to pivot up-and-down about said first axis without or while simultaneously pivoting about said second axis to the extent permitted;

(d) the extent of pivoting of said second platform permitted about each said axis being regulated by the angular relation of said levers, the positioning of the connections between said levers and linkages and the positioning of the connections between said linkages and brackets.

2. A passive exercising apparatus as claimed in claim 1 wherein said means to drive said drive shaft comprises a variable speed motor.

3. A passive exercising apparatus as claimed in claim 1 including:

(a) cushion means mounted respectively on said first and second platforms; and (b) an auxiliary platform mounted for lengthwise movement along said second platform and adapted to support said cushion means.

4. A passive exercising apparatus as claimed in claim 1 wherein said lever arms and brackets are slotted to facilitate said pivotal connections.

5. A passive exercising apparatus as claimed in claim 3 including a slidable cushion assembly mounted on the upper surface of said cushion means, said slidable cushion assembly comprising a cushion mounted for lengthwise movement along the second platform to reduce friction between a user and said cushion means.

* * * * *